US005867132A

United States Patent [19]

Blasing et al.

[11] Patent Number: 5,867,132

[45] Date of Patent: Feb. 2, 1999

[54] ADJUSTABLE ANTENNA MOUNTING ASSEMBLY

[75] Inventors: Raymond R. Blasing, Los Altos; Mark D. Brinkerhoff, San Jose; John R. Sanford, Palo Alto; James A. Wilfong, San Carlos, all of Calif.

[73] Assignee: Endgate Corporation, Sunnyvale, Calif.

[21] Appl. No.: 708,838

[22] Filed: Sep. 9, 1996

[51] Int. Cl.[6] ..... H01Q 1/12

[52] U.S. Cl. ..... 343/890; 343/878; 248/218.4

[58] Field of Search ..... 343/878, 882, 343/890, 892; 248/183, 218.4, 220.2, 225.31, 219.3

[56] References Cited

U.S. PATENT DOCUMENTS

| | | | |
|---|---|---|---|
| D. 361,068 | 8/1995 | Brehmer et al. | D14/238 |
| 4,109,251 | 8/1978 | MacDougall | 343/715 |
| 4,654,612 | 3/1987 | Smith | 343/890 |
| 4,755,830 | 7/1988 | Plunk | 343/890 |
| 4,799,642 | 1/1989 | Wright | 343/890 |
| 5,291,211 | 3/1994 | Tropper | 343/890 |
| 5,402,139 | 3/1995 | Maeshima | 343/878 |
| 5,453,756 | 9/1995 | Lowrey | 343/892 |
| 5,467,955 | 11/1995 | Beyersmith | 248/219.3 |

*Primary Examiner*—Don Wong
*Assistant Examiner*—Tan Ho
*Attorney, Agent, or Firm*—Gregory T. Kavounas; Anderson & Adamson

[57] ABSTRACT

An antenna base has a holding structure for installing an antenna directly thereon. The base also has a base plate with an axis perpendicular to the axis of an installed antenna. An antenna mounting plate is suitable for having the base plate affixed to it. The antenna mounting plate is supported relative to a pole clamp by a spherical shell. The mounting plate, exposed through an opening in the shell, is supported for rotating about a horizontal axis passing through the plate to provide for elevation angle adjustment. Locking screws are used to secure the adjusted elevation angle. The pole clamp has a pair of axially spaced tracks that define an arcuate path that extends circumferentially around at least a portion of the clamp. The shell is held in position adjacent to the clamp by two pairs of guide elements in a way that allows the shell to move along the arcuate path. An adjustment screw is used to adjust the position of the shell along the arcuate path, thereby adjusting the azimuth of the antenna about a vertical axis. Locking screws are used to secure the adjusted azimuth orientation.

43 Claims, 10 Drawing Sheets

ADJUSTABLE ANTENNA MOUNTING ASSEMBLY

BACKGROUND OF THE INVENTION

1. Field of the Invention

The present invention relates to assemblies for mounting antennas to poles.

2. Description of Related Art

The present invention is particularly intended for use on directional antennas, although it may be used for omni-directional antennas as well. A directional antenna is an antenna with a gain that is sensitive to its angular orientation. The angular orientation is commonly measured in terms of azimuth (i.e. "horizontal angle") in combination with an elevation (i.e. "vertical") angle. An assembly for mounting such an antenna is preferably provided with a bracket that includes a clamp for mounting to the pole and a support structure for supporting the antenna relative to the clamp. The bracket typically also has components for adjusting each of the azimuth and the elevation angle, so that the gain can be maximized. The support structure is attached fixedly to the clamp, and azimuth and elevation angle of the antenna plate are adjusted with respect to the support structure.

Adjustment of the azimuth is obtained conventionally by orienting the bracket around the vertical pole properly. A separate component might not be provided for adjusting the azimuth. For example, the bracket illustrated in U.S. Pat. No. Des. 361,068, provides for only elevation angle adjustment.

The adjustability of the orientation of the clamp around the pole may not provide a high enough resolution in azimuth, especially for heavy or highly directional antennas that permit only a small error in angular orientation. Indeed, some microwave antennas weigh over 50 lbs. To be installed, the assembly must be lifted up to the desired point on the pole and then, with the associated transceiver operating, rotated horizontally around the pole until the maximum gain is registered. That procedure determines the exact orientation for clamping, which must be maintained continuously during attachment of the clamp to the pole.

Given such difficulties, many bracket assemblies are provided with an additional component for azimuth adjustment. FIG. 1 shows a representative conventional bracket providing such azimuth adjustment. A directional antenna transceiver 40 is mounted on a pole 42 by a bracket assembly 44 supporting an antenna base 46, to which the transceiver is attached. Bracket assembly 44 has a clamp 48 and a support structure 50 that is attached to the clamp. The bracket assembly is further provided with an azimuth adjusting screw 52, which couples the base to the support structure. The adjusting screw rotates the antenna around pivot point 54 along the direction indicated by the arrow 56. An elevation adjustment component, not shown in the plan view of FIG. 1 is also included in the bracket.

A problem with such brackets is that large mechanical stresses or loads become highly concentrated on very few components. Pivot point 54 is subjected to large loads because of the weight of the antenna and strong wind forces. Moreover, screws that adjust the azimuth angle are subjected to the wind forces, while screws that adjust the elevation angle are subjected to the weight of the antenna.

What aggravates this problem is the competing design requirements of the azimuth and elevation angle adjusting screws. Such screws should have fine threads to provide a high resolution for tuning the antenna angle they control. Simultaneously, they should be robust enough to withstand large forces applied to them, without losing the set adjustment.

Another source of problems is that the adjustment components are exposed. These components are thus subject to deterioration due to the weather, vulnerable to vandalism, and unsightly (which can be a problem in code stringent areas).

SUMMARY OF THE INVENTION

The present invention provides an antenna mounting assembly that overcomes these disadvantages of the prior art. More specifically, one aspect of the present invention provides a mounting assembly that provides for angular adjustment while providing stable antenna support. The support structure is preferably in the form of a load-bearing shell that encloses the pole, the clamp and any adjustment components, and has an aesthetically appealing shape.

These features are provided generally in a mounting assembly having a support structure connected to the clamp in a manner preferably allowing movement of the support structure relative to the clamp. A guide assembly couples the clamp and the support structure for guiding the support structure along an arcuate path extending circumferentially around at least a portion of the clamp. A mechanism is provided for fixing the position of the support structure relative to the clamp.

In the preferred embodiment of the invention, the clamp has a pair of axially spaced tracks, forming part of the guide assembly, that define an arcuate path extending circumferentially around at least a portion of the clamp. The support structure is in the shape of a spherical shell that is held in position adjacent to the clamp by two guide elements in a way that allows the shell to move along the arcuate path. An adjustment screw is used to adjust the position of the shell along the arcuate path, thereby adjusting the azimuth of the antenna about a vertical axis. Additional locking screws are used to secure the adjusted azimuth angle orientation.

An antenna mounting plate is supported relative to the clamp by the shell. The plate, exposed through a circular opening in the shell, is supported for rotating relative to the shell about a horizontal axis, with the elevation angle being adjustable by an adjustment screw and fixable by locking screws extending between the plate and the shell.

An antenna base supports the antenna perpendicularly with respect to the antenna mounting plate. The base has a base plate that is attached to the antenna mounting plate by bolts. The base also has a holding structure to which the antenna is directly attached.

It can be seen that such a mounting assembly has several beneficial features. The continuous shell covering encloses the clamp and mounting assemblies, thereby protecting them from the environment and from vandalism. The shell may be formed in an aesthetically appealing and aerodynamically efficient shape, such as a sphere, that conforms to the arcuate travel path, and provides support for the antenna mounting plate, the azimuth and elevation angle adjusting assemblies, and the rotational bearing mounts associated with the guide assembly and mounting plate. These and other features of the present invention will be apparent from the preferred embodiment described in the following detailed description and illustrated in the accompanying drawings.

Some of these FIGS. are computer generated with a format that shows curved lines and surfaces as a collection of connected flat lines and surfaces.

DETAILED DESCRIPTION OF THE PREFERRED EMBODIMENT

As has been mentioned, the invention provides for an antenna mounting assembly for supporting a directional or omni-directional antenna on a pole. The pole is typically vertical and of a round cross section, although neither is a requirement for practicing the invention, as will be apparent from the following description.

Figure 1:
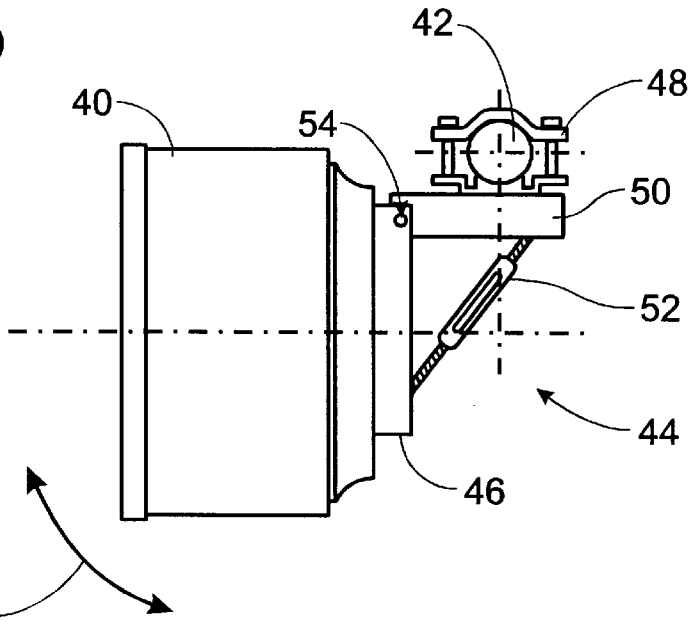
Fig. 1 (PRIOR ART)
FIG. 1 is a plan view of an antenna mounting assembly in the prior art.
Figure 2:
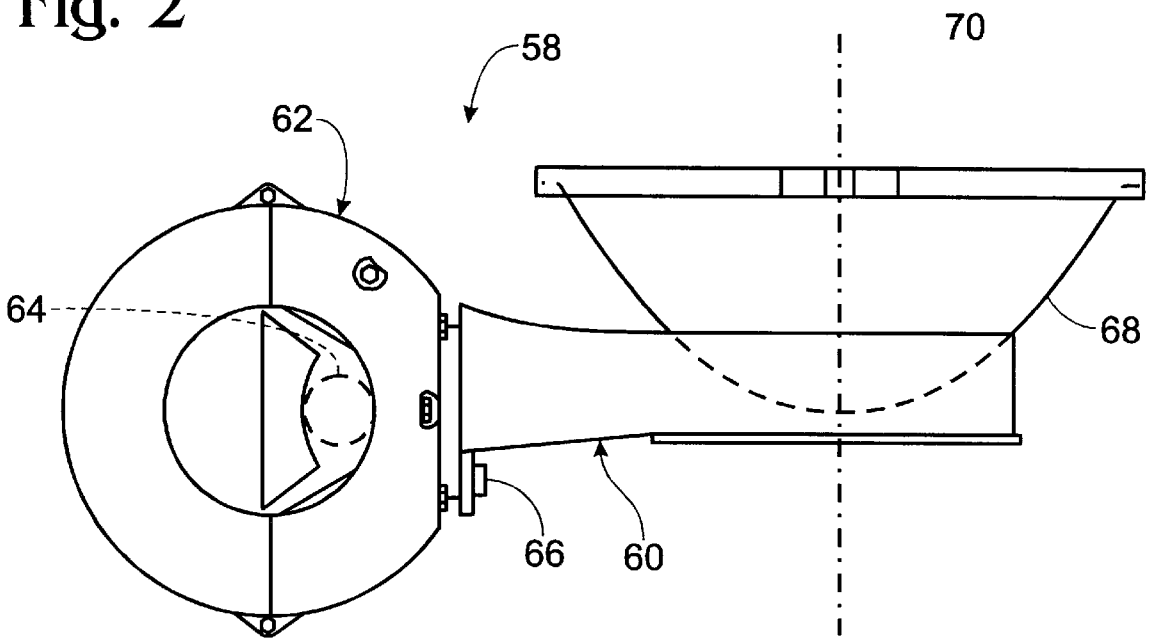
FIG. 2 is a plan view of an antenna mounting assembly made according to the invention.
Figure 3:
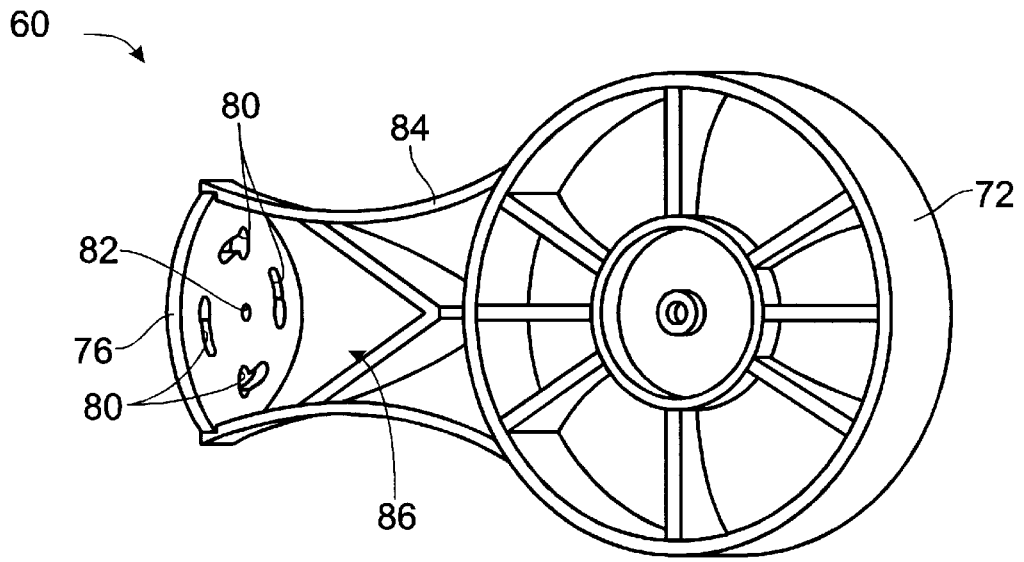
FIGS. 3 and 4 are perspective views of the open side of an antenna base included in the mounting assembly of FIG. 2.
Figure 4:
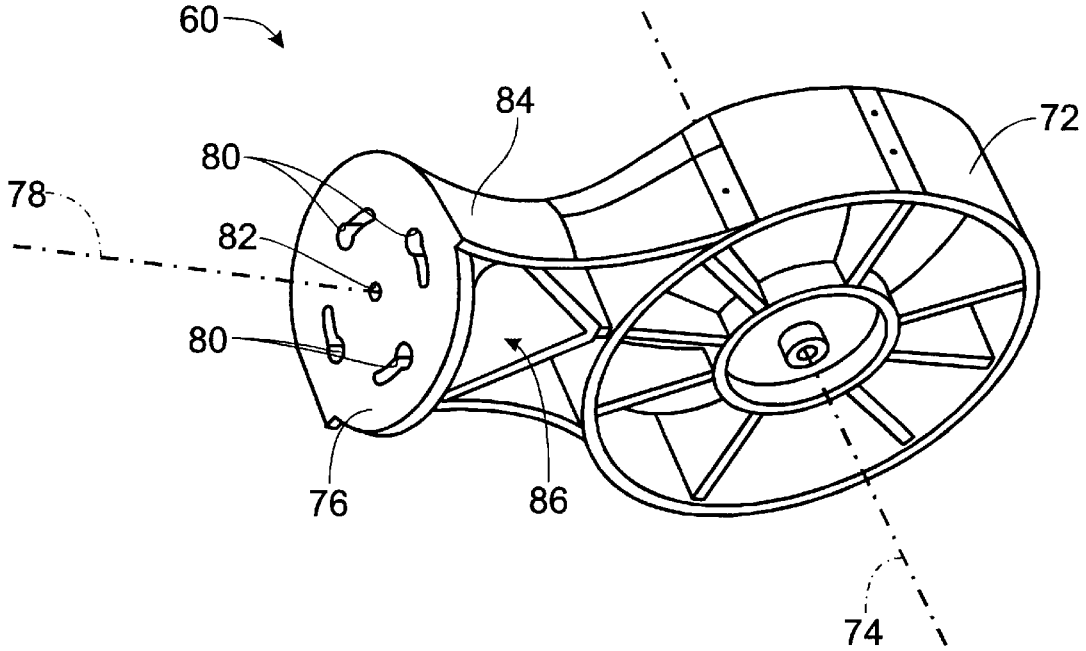
Figure 5:
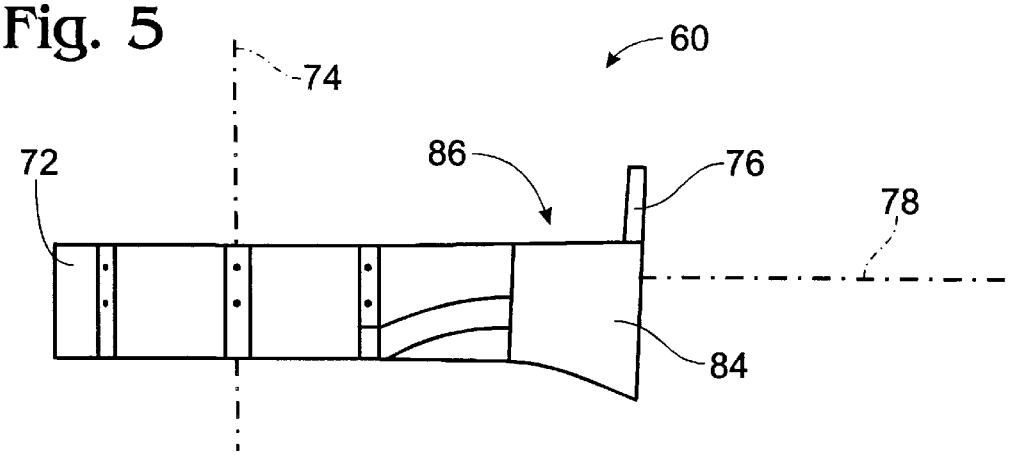
FIG. 5 is a side view of the antenna base of FIG. 3.
Figure 6:
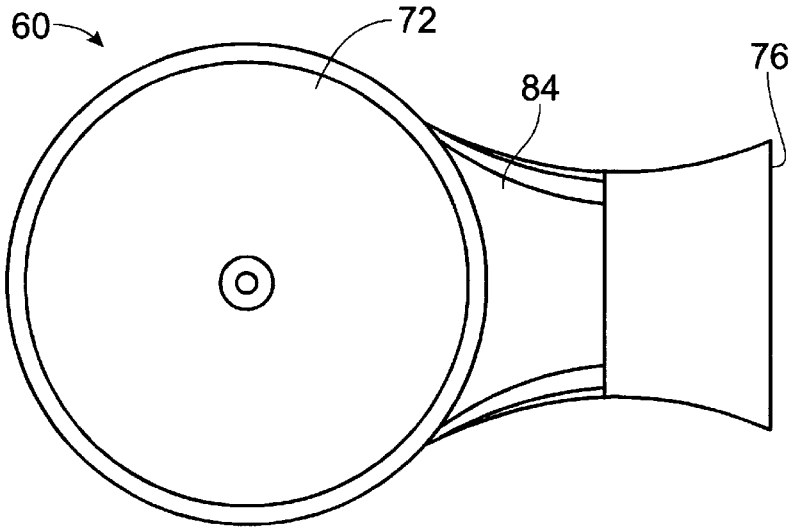
FIG. 6 is a plan view of the closed side of the antenna base of FIG. 3.
Figure 7:
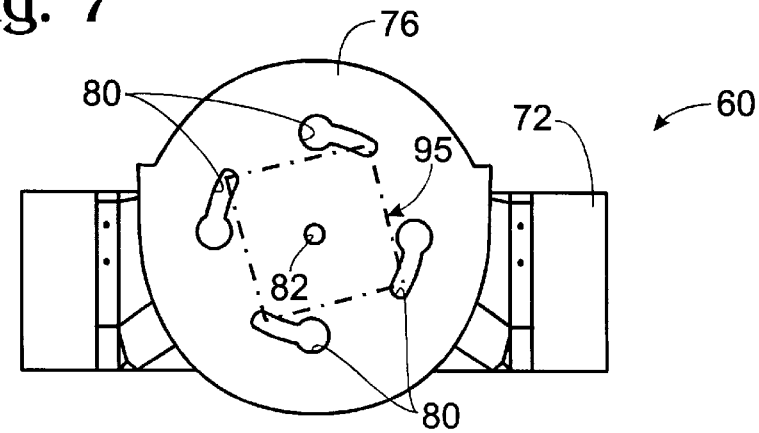
FIG. 7 is an end view of the antenna base of FIG. 3 illustrating a base plate included in the antenna base.

FIG. 2 shows an antenna mounting assembly 58 made according to the invention. Assembly 58 comprises an antenna base 60 (or simply "base") and an antenna bracket assembly 62 (or simply "bracket") for mounting on a pole 64. The bracket includes azimuth and elevation angle adjustment mechanisms. The base is attached to the bracket with attaching bolts such as bolt 66. An antenna 68, having a direction of communication along axis 70, is attached fixedly to the base.

Antenna base 60 is now described in more detail with reference to FIGS. 3–7. Base 60 includes an antenna holding structure 72 to which a directional antenna (not shown) is directly attached. The holding structure is of any suitable shape for the antenna 68 to be directly attached thereon; in the case of round antenna 68 the holding structure is correspondingly circular, having an axis 74 of symmetry that is coincident with axis 70 of an installed antenna.

Base 60 also includes a base plate 76 that attaches to the bracket assembly. The base plate is planar, and is circular about a central axis 78 perpendicular to its plane and perpendicular to axis 74. The base plate also has at least one screw hole 80 for bolt 66 (not shown) to be received therethrough. Preferably there are four screw holes 80, which are arranged to form a base pattern that is discussed in more detail below. Each screw hole 80 is formed as an elongated slit, with one end of the slit enlarged, to allow the head of a bolt 66 to pass through it. The directions of the slits along the base plate should also conform to the base pattern. The base plate preferably has a central hole 82 for use in mounting and aligning the base plate during installation, as discussed below.

A joining structure 84 connects base plate 76 with antenna holding structure 72. Since the direction of the antenna will end up being perpendicular to base plate axis 78, a rotation of the base plate around its axis does not affect the azimuth of the antenna, but does vary the angle of elevation. Joining structure 84 is attached to the base plate in such a way as to leave at least a pocket 86 of empty space for an installer to tighten bolts 66 protruding through screw holes 80.

The individual components of the bracket are now described in detail with general reference to FIGS. 8 through 15. Bracket 62 comprises an elevation plate 88, also referred to as an antenna mounting plate or element. Elevation plate 88 is adapted for supporting base 60 and directional antenna 68 (not shown in FIGS. 8–15) when fixedly mounted thereon. The elevation plate preferably has a planar circular antenna base surface 90, on which the base plate of the antenna base is mounted. The plate also preferably has a plurality of spaced, threaded bores, such as bore 92, for receiving attaching bolts 66 during mounting of an antenna base onto the elevation plate.

Bores 92 form a bracket pattern that preferably corresponds to several replications of the base pattern on the base plate. The base pattern of screw holes 80 preferably matches at least two of bores 92 of the bracket pattern, to enable a robust attachment of the base plate to the elevation plate. The patterns preferably coincide so that each screw hole 80 is matched with a bore 92. Pattern coincidence is in a number of desired positions of the base relative to the elevation plate, and is preferably implemented for positions that repeat at angular intervals, as is described below.

The bracket preferably also includes a center pin 94, attached to elevation plate 88, and extending from the center of surface 90. Moreover, aforementioned central hole 82 of the base plate is preferably circular and sized to receive center pin 94. So, when the base is placed so that the pin is inserted in the central hole, the base can be rotated around the elevation plate. The center pin is thus useful for guiding rotation of an antenna attached to an antenna base having a base plate, which base plate includes a central hole for receiving pin 94.

Rotating the base around the center pin of the elevation plate of the preferred embodiment causes the base pattern to coincide with different bracket patterns at regular angular intervals. For example, in the base plate of FIG. 7 there are four screw holes 80 arranged in a square pattern 95, and all at a single radius from central hole 82. There are twelve bores 92 in the elevation plate 88 of FIG. 8, arranged 30 degrees apart in a circle of the same radius. There are thus 12 positions where the patterns coincide. It will be appreciated that this feature provides the installer with a large number of corresponding initial orientation selections, and therefore operates as a coarse elevation angle adjustment for the antenna mounting assembly of the invention. The slits associated with holes 80 provide additional adjustment between the base and elevation plates.

The fact that the twelve bores are at 30 degree increments around a full circle means that an antenna can be placed, at a coarse level, in any general direction. This allows the installer to choose on which side of a pole to position the antenna, and it allows installation on horizontal poles or even angled poles.

Figure 8:
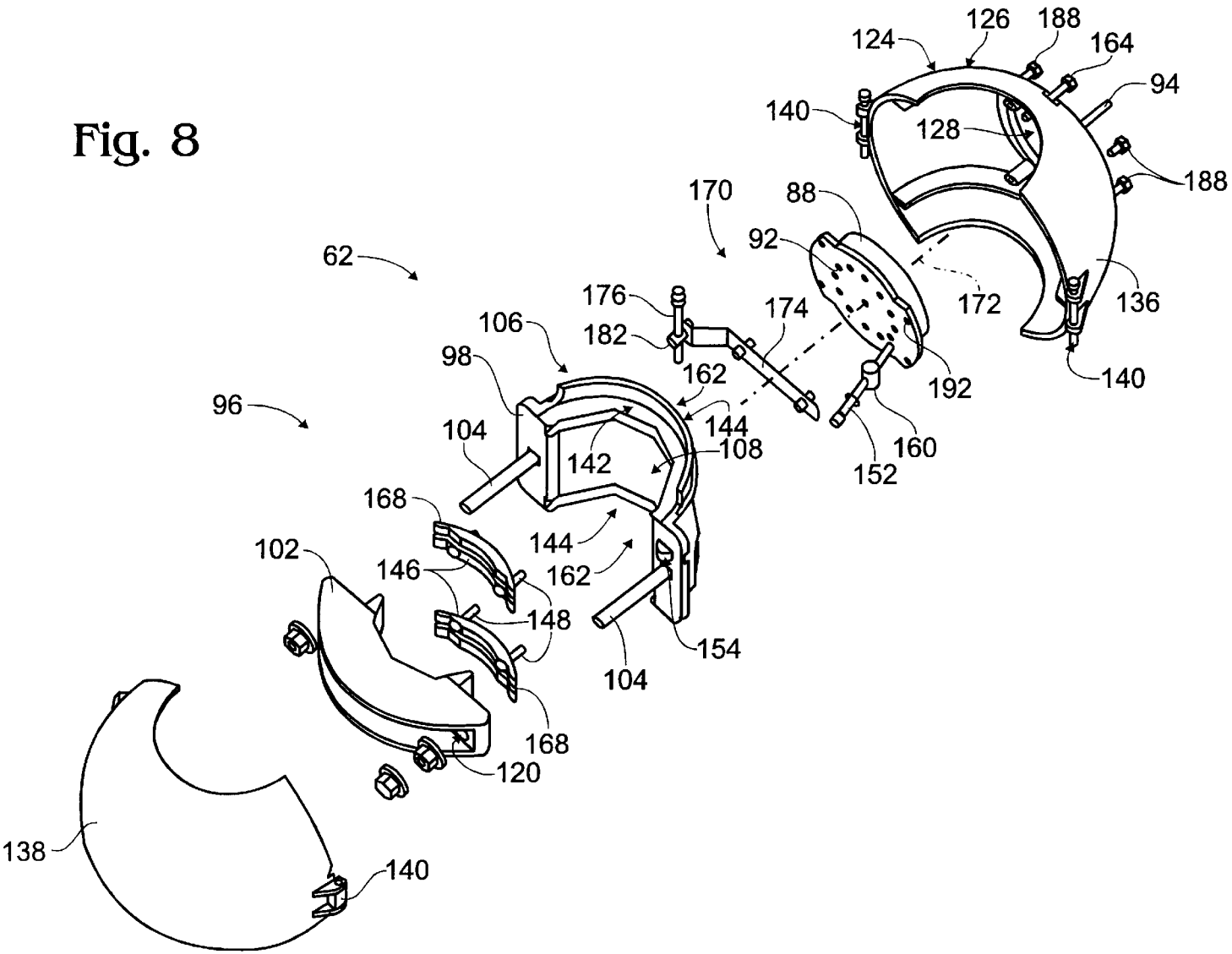
FIG. 8 is an isometric exploded view illustrating individual components of an antenna bracket assembly similar to the bracket assembly included in the mounting assembly of FIG. 2.
Figure 9:
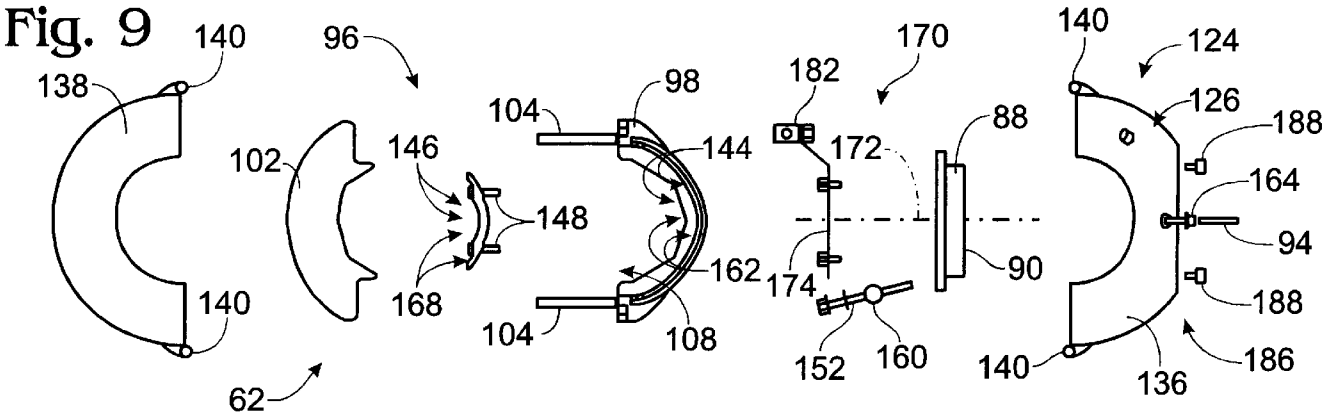
FIG. 9 is a plan view of the components of the antenna bracket assembly of FIG. 8.

Bracket 62 also includes a clamp 96 for mounting onto a pole 64, the components of which are shown in FIGS. 8 and 9. Clamp 96 is also referred to as clamping means. Clamp 96 includes a main clamp element or jaw 98 and a back clamp element or jaw 102, connected by clamp bolts 104. Main clamp element 98 is specially adapted to form part of a guide assembly 106 described below. When assembled, clamp 96 defines a channel 108 for receiving the pole to which bracket 62 is attached, as shown particularly in FIG. 20.

Clamp 96 can be made to accommodate a pole with a diameter varying from 1.75" to 4.5". The diameter is at least partially determined by the geometry and position of the interior surfaces of the jaws that define the channel between them. The design of clamp 96 can be scaled to accommodate poles with diameters in other ranges. For example, one can substitute regular back clamp 102 with an alternate back clamp 110 shown in FIGS. 10 and 11, which clamp is included in the assembly of FIG. 2. Back clamp 110 has an interior surface 112 for defining a smaller pole channel than back clamp element 102.

In addition, the clamp can be made to accommodate two alternative ranges of diameters by replacing the regular back clamp element with a reversible jaw 114 (seen in FIGS. 12 through 15), that presents two alternative interior surfaces 116, 118. The geometry of surface 116 is the same as that of the interior surface of regular back clamp 102, while the geometry of surface 118 is the same as that of interior surface 112. The two interior surfaces 116 and 18 are opposite each other, and the channel can be formed with the main jaw facing either one of them. Reversible jaw 114 has less structural strength than non reversible jaws 102 or 110 for a pole 64 of the same diameter, since the back side is not structurally as strong. It is therefore most useful where the antenna is not very heavy and the location not very windy.

Whether reversible or not, the back clamp element preferably has one round opening 120 for one of the clamp bolts and one slotted opening 122 for the other clamp bolt, as shown in FIGS. 11–15. This design allows the assembly to be partially preassembled, with the nuts in place on both clamp belts. This allows for ease of assembly and elimination of loose hardware during attachment to a pole.

Figure 22:
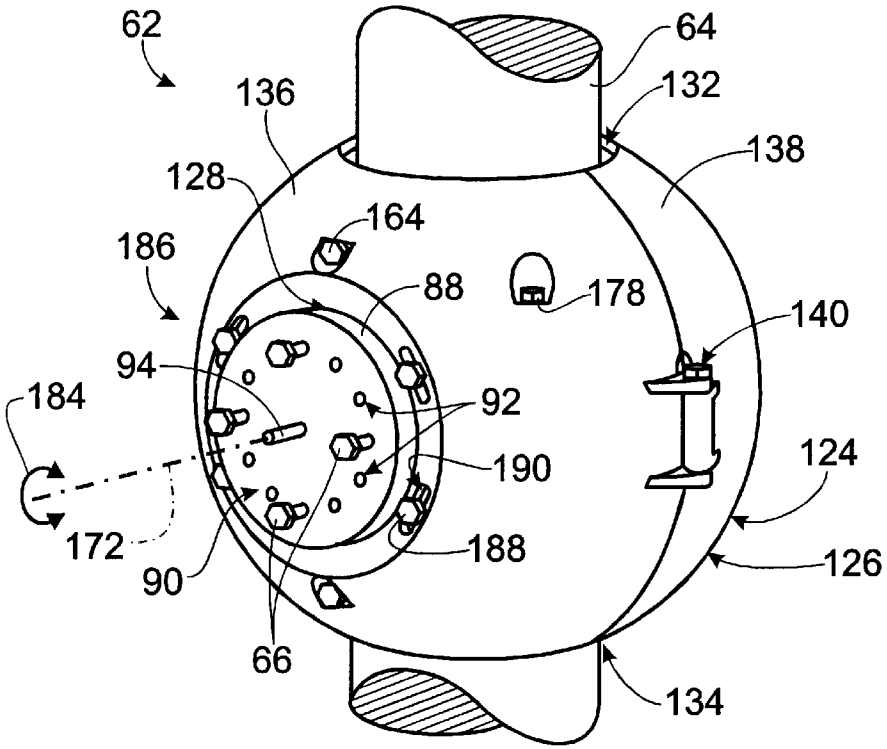
FIG. 22 is a view similar to FIG. 21 taken from the opposite side of the antenna bracket assembly.
Figure 21:
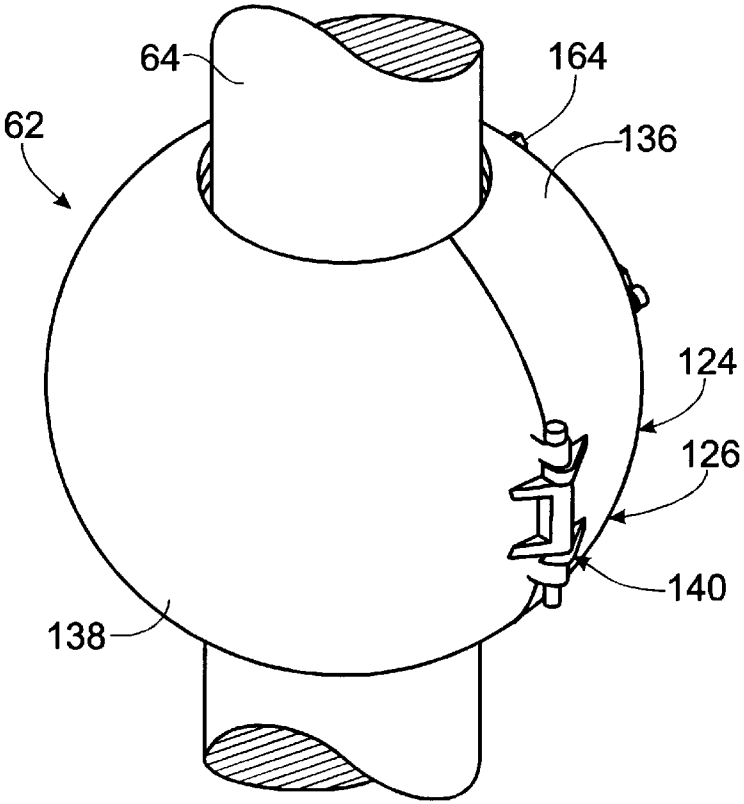
FIG. 21 is an isometric view of the antenna bracket assembly of FIGS. 2 or 8 assembled on a pole.
Figure 23:
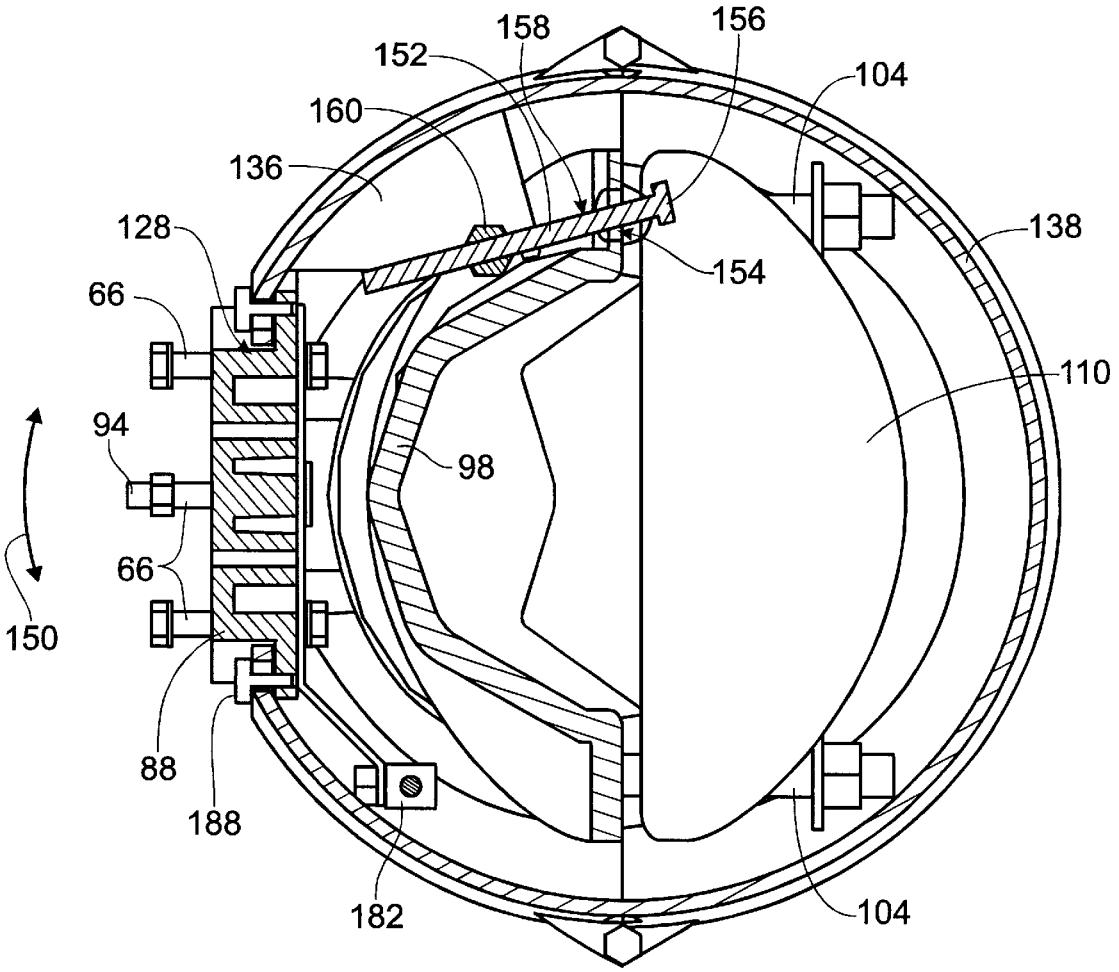
FIG. 23 is an enlarged section illustrating an azimuth adjustment mechanism of the antenna bracket assembly of FIG. 2 corresponding to a section taken along line A—A in FIG. 18.

A support structure 124 supports elevation plate 88 relative to clamp 96, and thereby supports an antenna attached to the elevation plate. As can be seen in the various Figures, the support structure includes a load bearing shell 126 that preferably covers at least a portion of clamp 96, and supports the elevation plate relative to the clamp. Referring briefly to FIGS. 21 and 22, antenna bracket assembly 62 is shown assembled on a pole 64. Shell 126 has a circular opening 128 for receiving and exposing elevation plate 88, as shown in FIGS. 22 and 23.

Figure 20:
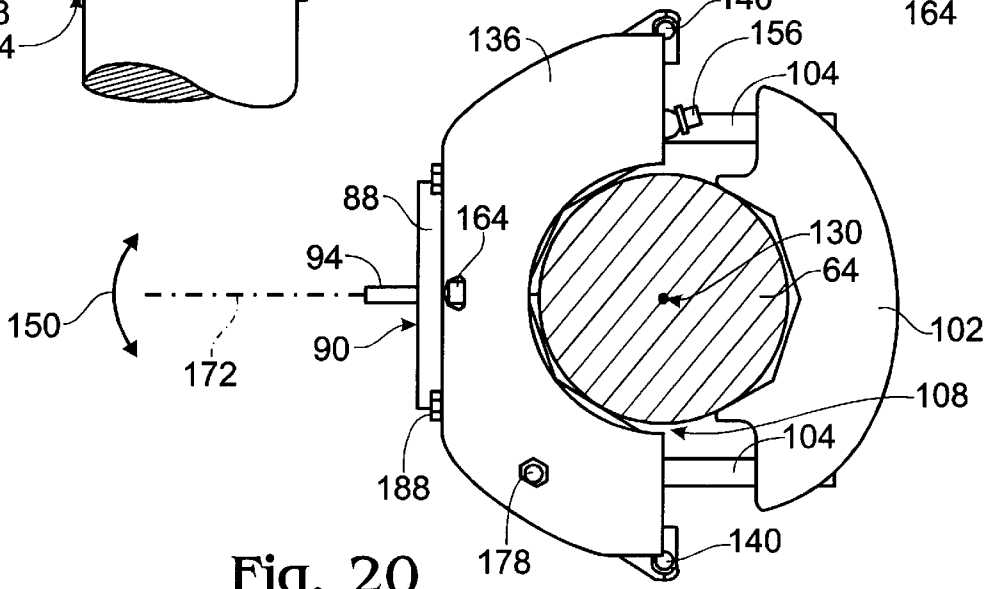
Figure 18:
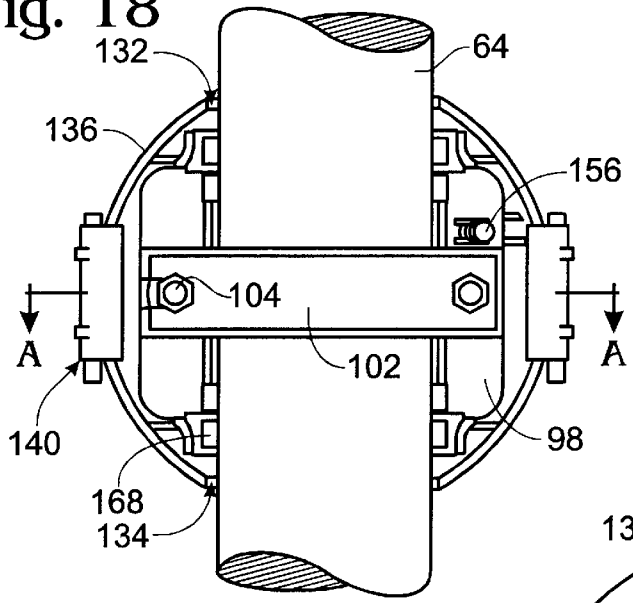

The shell preferably forms a continuous surface that has a shape substantially generated by revolving at least partially a line segment of a suitable shape around a main axis 130, shown in FIG. 20. The main axis is parallel to and may coincide with a center line or longitudinal axis of a pole 64, to which the bracket is attached, if regular back clamp 102 is used. Accordingly, if the line segment were a circular arc, the shape of the shell would be a slice of a spherical shell, extending circumferentially around the clamp, as is the case with shell 126. The line segment is such that the shape of the shell also has two opposite openings 132 and 134 (seen in FIG. 18), having centers on axis 130 that are positioned in line with pole receiving channel 108 of clamp 96. The openings are sized to accommodate the largest pole to which clamp 96 is designed to clamp onto.

Optionally and preferably, shell 126 includes a load bearing front member 136 and a rear member 138, also referred to as a ball back. Each of members 136 and 138 has a substantially hemispherical shape. The combination of members 136 and 138 form shell 126, which has a substantially spherical shape. Correspondingly, openings 132 and 134 are substantially circular for accommodating pole 64. Shell members 136 and 138 are hingedly attached to each other by a hinge 140 on each side. When one hinge pin is removed, the ball back can swing open to expose clamp 96 and thereby allow installation of bracket 62 around pole 64.

A support guide assembly 106 couples clamp 96 and shell member 136. The guide assembly guides the shell member along an arcuate path 142 extending circumferentially around at least a portion of the clamp 96. In the embodiment of FIG. 8 guide assembly 106 includes two tracks 144 that are situated at the top and bottom of the main clamp 98, and define arcuate path 142. The guide assembly further preferably includes two guide elements 146 that remain in contact with associated tracks 144 during movement of the shell member along the arcuate path. The guide elements are attached to shell member 136 by two screws 148 each. Accordingly, the shell member is moveable along path 142 around at least a portion of clamp 96. If the pole 64 is vertical, the movement changes the azimuth of the antenna mounting plate, as represented by arrow 150 in FIGS. 20 and 23. The arcuate path is preferably circular, in which case it has a center. The center coincides with axis 130 and also coincides with the axis of the pole if the pole is of the right diameter. In that case, the shell is able to rotate exactly around the center of the pole.

The azimuth adjustment is shown in better detail in FIG. 23. The azimuth of the elevation plate is adjusted by an angle-adjusting lead screw 152 that couples shell member 136 with clamp 96. The lead screw extends through a passage 154 in the main clamp element 98. A head 156 of the screw abuts one opening of the passage, while a snap ring 158 attached to the screw abuts the other opening of the passage. Lead screw 152 is threaded through an azimuth nut 160 that is pivotingly captured in a pocket formed between the shell and the main clamp element. Head 156 is accessible when ball back 138 is swung open. Thus, adjustment of lead screw 152 moves the shell member with respect to the clamp along the arcuate path, thereby adjusting the azimuth of the elevation plate with respect to the pole, as represented by arrow 150.

Referring back to FIG. 8 and continuing a description of guide assembly 106, main clamp element 98 preferably also has a pair of slits 162 that are collinear with the arcuate path, and preferably situated respectively above and below the respective upper and lower tracks 144. A pair of locking screws 164 are inserted through respective holes 166 (seen only in FIG. 25) in shell member 136, and through slits 162. Each locking screw is screwed tightly into a brake shoe 168, once the azimuth adjustment has been made. This way, screws 164 in combination with brake shoes 168 fix the position of the shell relative to the main clamp element. It will be appreciated that this arrangement overcomes the prior art problem of having two competing demands of a single angle adjustment assembly. Lead screw 152 provides fine resolution of the azimuth, while the strength to withstand the wind forces is provided by guide assembly 106 and locking screws 164. Further, for simplicity of design and manufacture, slits 162 are the same as the slits in tracks 144, and brake shoes 168 are identical to guide elements 146.

Elevation plate 88 is preferably supported by shell member 136 in such a way that the rotational or elevation angle of the plate can be changed for better aiming the antenna. Accordingly, an orientation adjustment assembly 170 adjusts the rotational orientation of the elevation plate about an axis 172 passing perpendicularly through the center of the plate. When base plate 76 is mounted on elevation plate 88, axis 172 is coextensive with axis 78. Adjustment of plate 88 about axis 172 operates as a fine adjustment of the elevation angle of an antenna facing perpendicular to a plane parallel to the axis. Further, the elevation plate is preferably supported vertically with respect to the ground, i.e. maintaining axis 172 horizontal, (perpendicular to axis 130). This way an azimuth adjustment will not necessitate a corresponding elevation angle adjustment.

Figure 25:
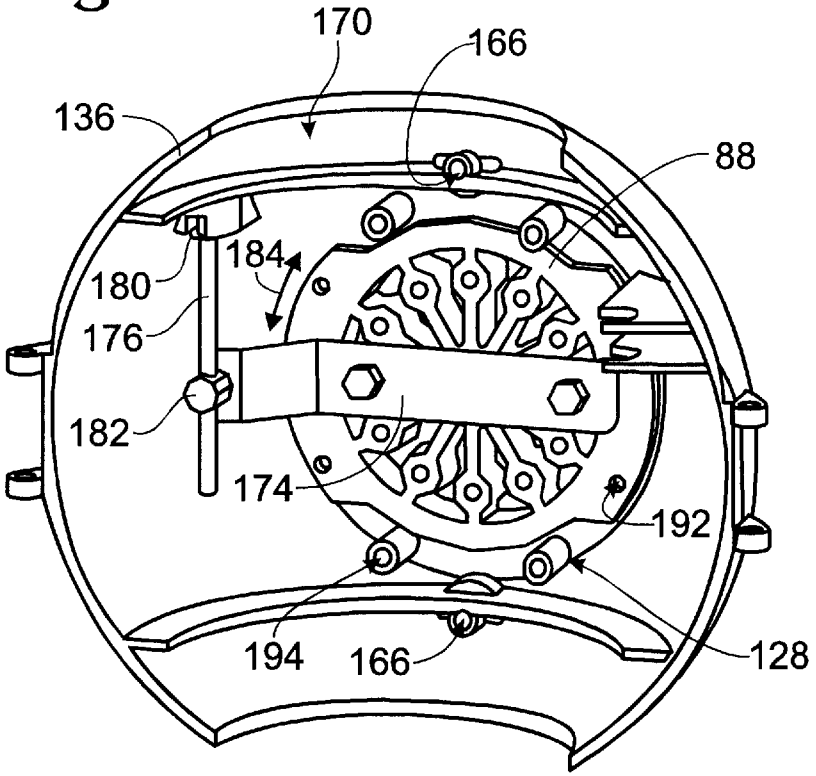
FIG. 25 is an isometric view of the elevation angle adjustment mechanism of FIG. 24 installed in a support structure made according to the invention.
Figure 24:
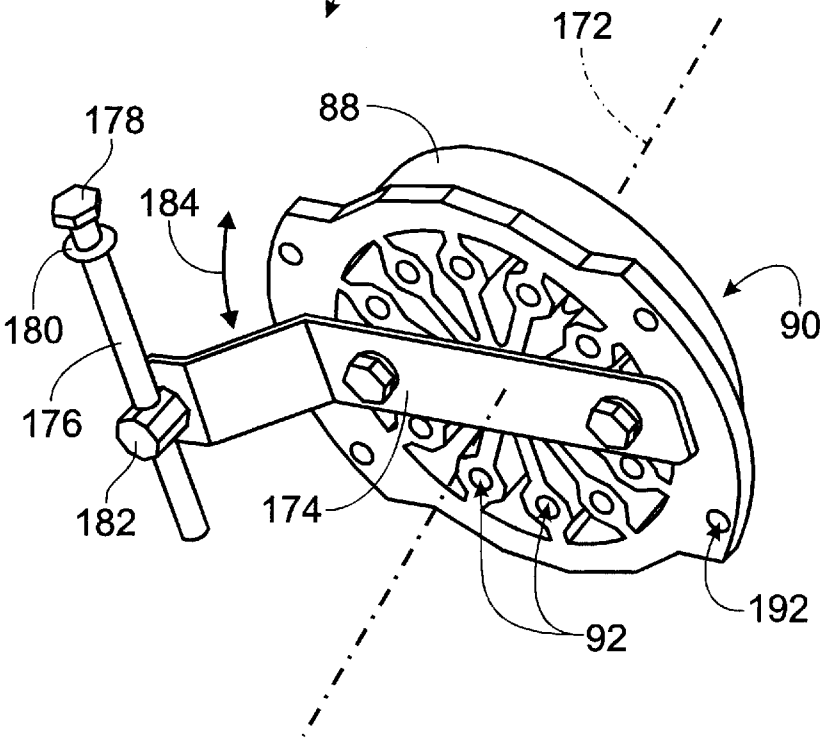
FIG. 24 is an isometric view of an elevation angle adjustment mechanism of an antenna bracket assembly included in the mounting assemblies of FIGS. 2 and 8.

Assembly 170 includes an elevation lever 174, also seen in better detail in FIGS. 24 and 25. The elevation lever is fixedly attached to plate 88. The tip 178 of an elevation screw 176 (which is also referred to as adjustable screw means) is rotatably attached to shell member 136 by means of a snap ring 180. The elevation screw is threaded through an elevation nut 182, which is pivotingly attached to the elevation lever. The elevation nut is spaced from axis 172, so that adjustment of elevation screw 176 causes lever 174 and plate 88 to rotate about axis 172. As can be seen the perimeter of plate 88 is circular and is matingly received in opening 128 in shell member 136. Opening 128, also referred to as rotation guide means, thus serves to capture plate 88 and guide rotation of the plate about axis 172. The adjustability of the elevation angle is represented by arrow 184.

Referring again to FIGS. 9 and 22, an elevation angle lock 186 secures elevation plate 88 to shell member 136, once the fine elevation adjustment has been made. The preferred angle lock includes at least one, and preferably four angle locking screws 188. Screws 188 pass through slits, such as slit 190, distributed around opening 128 in the shell member, and are matingly received in corresponding threaded bores, such as bore 192 (seen in FIGS. 8 and 25), in the elevation plate, once the elevation adjustment has been made. These screws fixedly secure the elevation plate to the shell. It is seen that the length of slits 190 defines the range of fine elevation angle adjustment. In the embodiment shown, the range is 10 degrees in either direction. This range may be changed by changing the length of the slits. The adjustability of the elevation plate to both the shell and the base plate provides for 360 degrees of overall adjustability.

Again it will be appreciated that this arrangement overcomes the prior art problem of having two competing demands on a single adjustment mechanism. Orientation adjustment assembly 170 provides fine resolution, while the strength to withstand the antenna weight is provided by angle lock 186.

Overall, the present design distributes loads more evenly around the structure, without letting them become concentrated on a few components. Therefore, the present design maximizes the strength of the assembly, while keeping its volume small.

A method of assembly of bracket 62 is now described with reference to all of the figures. Center pin 94 is pressed into the center hole of surface 90 of the elevation plate. Elevation lever 174 is attached to the back of elevation plate 88. Elevation nut 182 is then attached to the elevation lever. The elevation plate is received matingly into opening 128 of the shell. Elevation screw 176 is inserted through the associated opening in shell member 136, threaded through elevation nut 182, and fitted with snap ring 180. Screws 188 are fitted through slits 190, and loosely screwed into threaded bores 192 of the elevation plate to support it against the shell.

Guide elements 146 are then attached to shell member 136 by screws 148 passing through slits in tracks 144 of the clamp element 98 and into holes 194 of the shell member. Azimuth-adjusting lead screw 152 is inserted into passage 154, threaded through azimuth nut 160 of shell member 136, and captured by snap ring 158. The main clamp element is then nested into shell member 136 with azimuth nut 160 positioned in the associated pocket in the shell member. Azimuth locking screws 164 are then inserted through holes 166 of the shell, through slits 162 of the main clamp element, and are screwed loosely into brake shoes 168.

Figure 16:
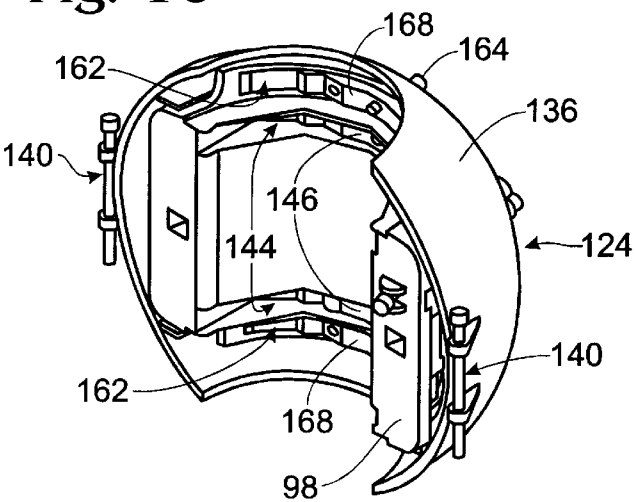
Figure 10:
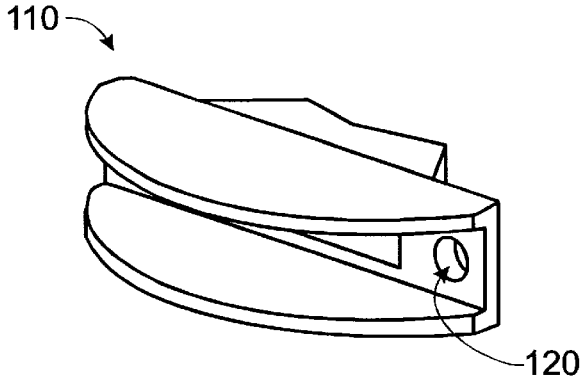
FIGS. 10 and 11 are isometric views of an alternate back clamp that may be used instead of the back clamp element shown in FIGS. 8 and 9.
Figure 11:
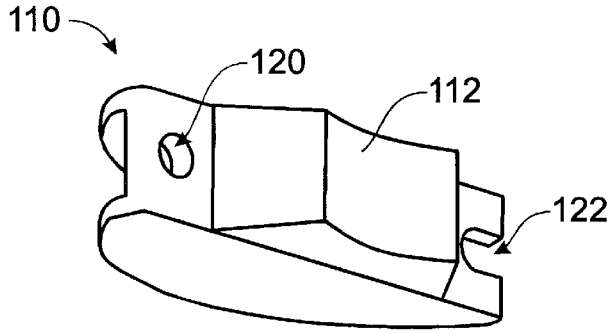
Figure 12:
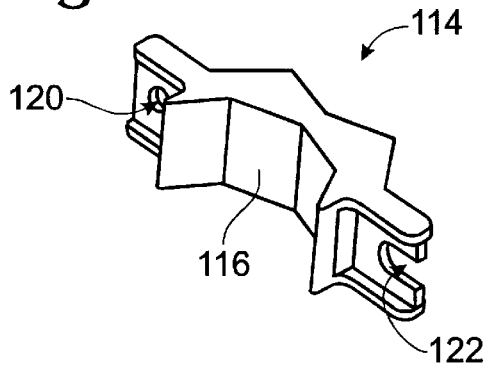
FIG. 12 is an isometric view of a reversible back clamp that may be used instead of the back clamp element shown in FIGS. 8–11.
Figure 13:
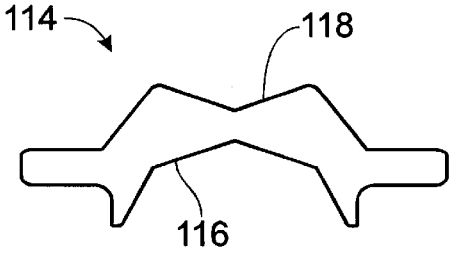
FIG. 13 is a plan view of the reversible back clamp of FIG. 12.
Figure 14:
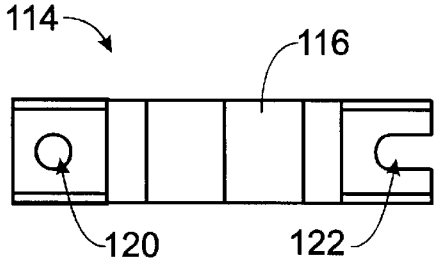
FIG. 14 is an elevation view showing a first interior surface of the reversible back clamp of FIG. 12.
Figure 15:
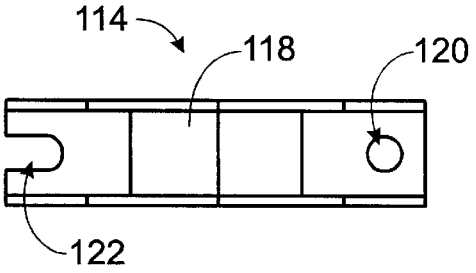
FIG. 15 is an elevation view showing a second interior surface of the reversible back clamp of FIG. 12.
Figure 19:
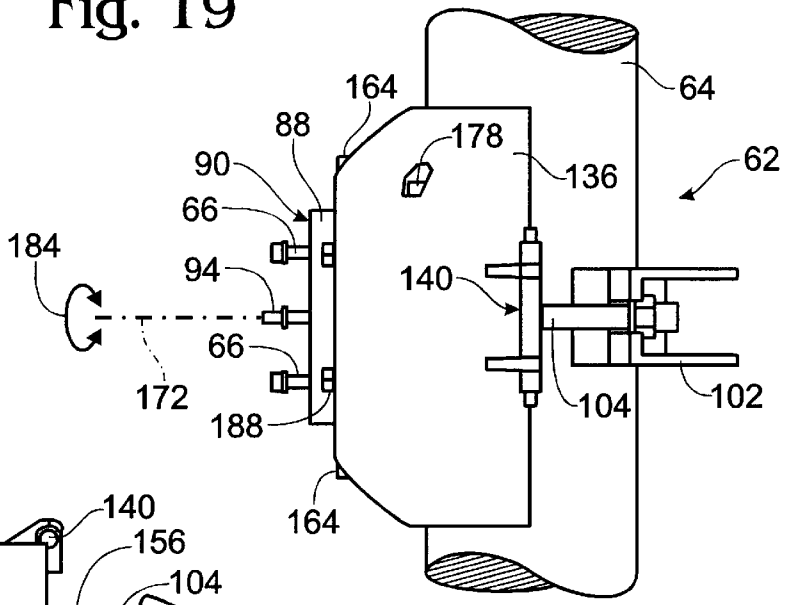

The assembly now looks substantially as shown in FIG. 16. One of clamp bolts 104 is then attached loosely to main clamp 98 and through round hole 120 of the back clamp, while the other clamp bolt is attached loosely with its nut to the main clamp only. The antenna base is then attached onto the elevation plate. Attachment, is by using four bolts 66, and in one of the elevation orientations permitted by the coincidence of the base pattern with the bracket pattern. The choice of orientation operates as a coarse elevation angle adjustment, as described above.

Figure 17:
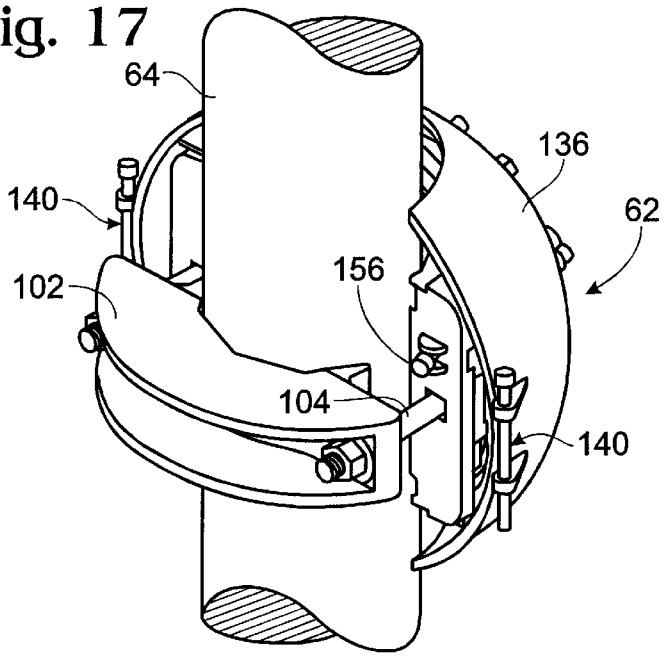
FIGS. 16–20 illustrate various views of the antenna bracket assembly of FIG. 8 partially assembled.

Main clamp element 98 is attached to the back clamp element around the pole 64 using clamp bolts 104. The assembly now looks substantially as shown in FIG. 17, except that the installed antenna base is not shown. The clamp attachment is performed taking care to orient approximately the axis of the antenna bracket toward the intended communication direction of the antenna, which orientation effectuates a coarse azimuth adjustment. The attachment is made exploiting the fact that one bolt opening in the back clamp element is slotted. This makes installation easier by keeping to a minimum the number of spare parts that an installer must handle while on the pole.

It will be appreciated that the antenna bracket assembly can be installed on a pole and secured before an antenna has to be mounted on it. Accordingly, by the time that the antenna is mounted on it and turned on for the fine azimuth and elevation, angle adjustments, it will be held in place by the bracket only (not the installer), which further facilitates installation. Further, later swapping of antennas can be performed without having to remove the bracket from the pole, thus maintaining the critical angle adjustments.

It will also be seen that mounting assembly 58 could also be installed on a horizontal or even an angled pole. Depending upon the orientation of the base, on a horizontal pole, the "azimuth" adjustment would adjust the elevation and the "elevation" adjustment would adjust the azimuth. On angled poles, both adjustments would affect both angles, so an iterative process of adjusting both adjustment mechanisms would be used to orient an antenna.

Additionally, the shape or length of the pole to which the assembly can be mounted could be varied. The clamp could be redesigned to attach to objects of different shapes, such as a square pole or even a plate or other structures with exposed surfaces suitable to be engaged by the clamp.

In the above description numerous details have been set forth in order to provide a more thorough understanding of the present invention. It will be obvious, however, to one skilled in the art that the present invention may be practiced using other equivalent designs.

The invention claimed is:

1. An antenna mounting assembly for supporting an antenna on a pole comprising:

pole clamping means defining a pole receiving channel and being capable of being attached to the pole received in the channel;

support means for supporting the antenna relative to the clamping means, the support means being mounted to the clamping means in a manner allowing movement of the support means relative to the clamping means;

support guide means coupling the clamping means and the support means for guiding the support means along an arcuate path extending circumferentially around at least a portion of the clamping means; and means for fixing the position of the support means relative to the clamping means.

2. The assembly of claim 1 wherein the support means includes a shell covering at least a portion of the clamping means.

3. The assembly of claim 2, wherein the shell supports the antenna relative to the clamping means.

4. The assembly of claim 2, wherein the shell is of a shape substantially generated by at least partially revolving a line segment around a main axis, the line segment being such that the shape further has two opposite openings positioned in line with the pole receiving channel.

5. The assembly of claim 2 wherein the shell extends circumferentially around the clamping means.

6. The assembly of claim 2 wherein the shell encloses the support guide means.

7. The assembly of claim 1 wherein the guide means comprises a track defining the arcuate path and at least one guide element in contact with the track during movement of the support means along the arcuate path.

8. The assembly of claim 1, further comprising adjustment means for adjusting the position of the support means along the arcuate path.

9. The assembly of claim 8, wherein the adjustment means includes an adjustable lead screw coupling the support means and the clamping means.

10. The assembly of claim 8, wherein the support means includes a shell covering at least a portion of the clamping means.

11. The assembly of claim 10 wherein the shell encloses the position adjustment means.

12. The assembly of claim 1, wherein the fixing means includes at least one brake shoe and at least one locking screw screwed through a threaded hole in the brake shoe and coupling the support means to the clamping means.

13. The assembly of claim 1, wherein the support means includes a mounting element and support structure for supporting the mounting element relative to the clamping means, the mounting element being rotatable relative to the support structure, the assembly further comprising orientation adjustment means for adjusting the rotational orientation of the mounting element relative to the support structure.

14. The assembly of claim 13, wherein the support structure includes a shell covering at least a portion of the clamping means and having an opening for exposing the mounting element.

15. The assembly of claim 14 wherein the shell substantially encloses the orientation adjustment means.

16. The assembly of claim 13, wherein the orientation adjustment means includes rotation guide means guiding rotational movement of the mounting element relative to the support structure and an adjustable screw means coupling the mounting element and the support structure.

17. The assembly of claim 13 further including angle locking means for securing the mounting element to the support structure at a given angle.

18. The assembly of claim 17, wherein the angle locking means includes at least one locking screw coupling the support structure to the mounting element.

19. The assembly of claim 1, wherein the clamping means includes a first clamp element, a second clamp element having two opposite surfaces defining channels of different sizes, and means for securing the first and second clamp elements onto the pole passing through the pole channel with either one of the two surfaces facing the first clamp element for defining the channel.

20. An antenna mounting assembly for supporting an antenna on a pole comprising:

pole clamping means defining a pole receiving channel and being capable of being attached to the pole received in the channel;

a mounting plate adapted for supporting the antenna thereon;

support means for supporting the mounting plate relative to the clamping means, the mounting plate being rotatable relative to the support means; and orientation adjustment means for adjusting the rotational orientation of the mounting plate relative to the support means, the orientation adjustment means including rotational guide means guiding rotational movement of the mounting plate relative to the support means and an adjustable screw means coupling the mounting plate and the support means.

21. The assembly of claim 20, wherein the support means comprises a shell enclosing the clamping means and the adjustable screw means, the shell having a first opening for exposing the mounting plate, and two opposite second and third openings positioned in line with the pole receiving channel.

22. The assembly of claim 20, further comprising an antenna base fixedly mountable to the antenna and including a base plate suitable for attaching fixedly onto the mounting plate.

23. The assembly of claim 22 further comprising means for attaching the base plate to the mounting plate in different orientations.

24. The assembly of claim 23 further comprising means for guiding rotation of the base plate with respect to the mounting plate.

25. The assembly of claim 24, wherein the base plate guiding means comprises a pin fixed to the center of one of the base and mounting plates and a hole in the other of the plates sized to receive the pin, the base plate thereby being able to rotate about an axis passing through the pin with respect to the mounting plate.

26. The assembly of claim 23, wherein the means for attaching the base plate to the mounting plate is adapted for attaching the base plate to the mounting plate in one of at least two oppositely facing orientations.

27. An antenna mounting assembly for supporting an antenna on a pole comprising:

pole clamping means defining a pole receiving channel and being capable of being attached to the pole received in the channel;

an antenna mounting element for supporting the antenna;

support means for supporting the mounting element relative to the clamping means, the mounting element being rotatable relative to the support means about a rotation axis passing through the mounting element; and orientation adjustment means for adjusting the rotational orientation of the mounting element relative to the support means.

28. The assembly of claim 27 wherein the support means includes a shell covering at least a portion of the clamping means and the orientation adjustment means adjusts the rotational orientation of the mounting element relative to the shell.

29. The assembly of claim 27 wherein the orientation adjustment means includes rotation guide means guiding rotational movement of the mounting element relative to the support structure and an adjustable screw means coupling the mounting element and the support structure.

30. The assembly of claim 29 wherein the support means includes a shell covering at least a portion of the clamping means and the guide means guides rotational movement of the mounting element relative to the shell.

31. An antenna mounting assembly for supporting an antenna on a pole comprising:

pole clamping means defining a pole receiving channel and being capable of being attached to the pole received in the channel;

an antenna mounting element for supporting the antenna;

support means for supporting the mounting element relative to the clamping means, the mounting element being rotatable relative to the support means; and position locking means for securing the mounting element to the support means at a given rotational position.

32. The assembly of claim 31 wherein the support means includes a shell covering at least a portion of the clamping means and the locking means secures the mounting element to the shell.

33. The assembly of claim 32 wherein the locking means includes at least one locking screw coupling the support structure to the mounting element.

34. The assembly of claim 33 wherein the support means includes a shell covering at least a portion of the clamping means and the locking screw secures the mounting element to the shell.

35. An antenna mounting assembly for supporting an antenna on a pole comprising:

pole clamping means defining a pole receiving channel and being capable of being attached to the pole received in the channel; and support means for supporting the antenna relative to the clamping means, the support means including a shell providing a continuous surface covering at least a portion of the clamping means.

36. The assembly of claim 35 wherein the shell supports the antenna relative to the clamping means.

37. The assembly of claim 36 wherein the shell extends substantially continuously around the clamping means.

38. The assembly of claim 35 further comprising:

support guide means coupling the clamping means and the support means for guiding the support means along an arcuate path extending circumferentially around at least a portion of the clamping means; and adjustment means for adjusting the position of the support means along the arcuate path.

39. The assembly of claim 38 wherein the shell encloses the position adjustment means.

40. The assembly of claim 38 wherein the adjustment means includes an adjustable lead screw coupling the shell and the coupling means.

41. The assembly of claim 40 wherein the shell encloses the adjustable lead screw.

42. An antenna mounting assembly for supporting an antenna on a pole comprising:

pole clamping means defining a pole receiving channel and being capable of being attached to the pole received in the channel;

an antenna base fixedly mountable to the antenna and including a base plate having a central hole;

a mounting plate adapted for attaching the base plate thereon in different orientations with respect to the mounting plate, the mounting plate including a pin, the central hole of the base plate being sized to receive the pin for guiding rotation of the base plate with respect to the mounting plate about a center axis passing through the pin;

a shell for supporting the mounting plate relative to the clamping means, the shell being mounted onto the clamping means in a manner allowing movement of the shell relative to the clamping means along an arcuate path extending circumferentially around at least a portion of the clamping means, the shell enclosing the clamping means and having a first opening for exposing the mounting plate and two opposite second and third openings positioned in line with the pole receiving channel, the mounting plate being rotatable relative to the shell about an axis passing through the mounting plate;

orientation adjustment means for adjusting the rotational orientation of the mounting plate relative to the shell, the orientation adjustment means including rotational guide means guiding rotational movement of the mounting plate relative to the shell and an adjustable screw means coupling the mounting plate and the shell;

an adjustable lead screw coupling the shell and the clamping means for adjusting the position of the shell along the arcuate path; and means for fixing the position of the shell relative to the clamping means, the fixing means including at least one brake shoe and at least one locking screw screwed through a threaded hole in the brake shoe and coupling the shell to the clamping means.

43. The assembly of claim 42 wherein the shell encloses the adjustable lead screw.

* * * * *